US011709016B2

(12) United States Patent
Ayyawar et al.

(10) Patent No.: US 11,709,016 B2
(45) Date of Patent: Jul. 25, 2023

(54) SUPPORT ASSEMBLY FOR AN APPLIANCE

(71) Applicant: WHIRLPOOL CORPORATION, Benton Harbor, MI (US)

(72) Inventors: Kapil Ayyawar, St. Joseph, MI (US); Vincent F. Bertolino, Kalamazoo, MI (US); Umakant Suresh Katu, St. Joseph, MI (US); Ian M. Pavnick, Michigan City, IN (US); Ryan Michael Post, Coloma, MI (US); Adam Thomas Needham, Coloma, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/684,709

(22) Filed: Mar. 2, 2022

(65) Prior Publication Data

US 2022/0187011 A1 Jun. 16, 2022

Related U.S. Application Data

(63) Continuation of application No. 16/736,188, filed on Jan. 7, 2020, now abandoned.

(51) Int. Cl.
*F25D 25/02* (2006.01)
*F25D 23/06* (2006.01)

(52) U.S. Cl.
CPC ..... *F25D 25/027* (2013.01); *F25D 23/069* (2013.01); *F25D 25/022* (2013.01); *F25D 25/024* (2013.01); *F25D 2325/021* (2013.01); *F25D 2325/023* (2013.01)

(58) Field of Classification Search
CPC .... F25D 23/065; F25D 23/067; F25D 23/069; F25D 25/024; F25D 25/027; F25D 2325/021
See application file for complete search history.

(56) References Cited

U.S. PATENT DOCUMENTS

| | | | |
|---|---|---|---|
| 1,899,171 | A | 2/1933 | Warren |
| 1,932,003 | A | 10/1933 | West |
| 2,092,430 | A | 9/1937 | Stratton |
| 2,104,939 | A | 1/1938 | Whalen |
| 2,222,201 | A | 11/1940 | Ito |
| 2,692,813 | A | 10/1954 | Toronto |
| 2,877,077 | A | 3/1959 | Robinson et al. |

(Continued)

FOREIGN PATENT DOCUMENTS

| | | | | |
|---|---|---|---|---|
| EP | 2005093 | A2 | 12/2008 | |
| KR | 200190487 | Y1 * | 8/2000 | ..... F25D 25/02 |

(Continued)

*Primary Examiner* — Andrew M Roersma
(74) *Attorney, Agent, or Firm* — Price Heneveld LLP

(57) ABSTRACT

A support assembly includes a support surface configured to selectively transition between a stowed position, a deployed position, and an intermediate position defined between the stowed position and the deployed position. A retention feature is operably coupled to the support surface and is configured to transition the support surface between the stowed position and the deployed position. The retention feature includes a projection about which the support surface pivots to define a pivot axis. A bracket is coupled to the support surface and is configured to distribute a load along the support assembly in the intermediate position and the deployed position.

19 Claims, 13 Drawing Sheets

(56) References Cited

U.S. PATENT DOCUMENTS

| | | | | | |
|---|---|---|---|---|---|
| 2,966,388 | A * | 12/1960 | Charles | F25D 25/024 312/333 |
| 3,101,227 | A | 8/1963 | Pugh | |
| 3,550,982 | A | 12/1970 | Zaidan | |
| 4,436,356 | A | 3/1984 | Stelling | |
| 5,497,878 | A | 3/1996 | Sandonato | |
| 8,016,374 | B2 * | 9/2011 | Kropf | A47B 88/463 312/334.44 |
| 8,882,211 | B2 | 11/2014 | Jang et al. | |
| 9,562,714 | B2 | 2/2017 | Lim | |
| 9,709,322 | B2 | 7/2017 | Jenkinson et al. | |
| 9,879,901 | B2 | 1/2018 | Lim | |
| 2011/0083465 | A1 * | 4/2011 | Kim | F25D 25/027 62/449 |
| 2018/0202708 | A1 | 7/2018 | Chen | |
| 2018/0356145 | A1 | 12/2018 | Candido et al. | |

FOREIGN PATENT DOCUMENTS

| | | | | |
|---|---|---|---|---|
| KR | 100651279 | B1 | 11/2006 | |
| KR | 1020120061520 | A * | 6/2012 | F25D 25/02 |
| KR | 1020130094042 | A | 8/2013 | |
| KR | 1020140085645 | A * | 7/2014 | F25D 25/02 |
| WO | 9512793 | A1 | 5/1995 | |
| WO | 2007115867 | A2 | 10/2007 | |
| WO | 2008080921 | A2 | 10/2008 | |
| WO | 2010029053 | A2 | 3/2010 | |
| WO | 2011138114 | A1 | 11/2011 | |
| WO | 2016044864 | A1 | 3/2016 | |

* cited by examiner

SUPPORT ASSEMBLY FOR AN APPLIANCE

CROSS-REFERENCE TO RELATED APPLICATION

This application is a continuation of U.S. patent application Ser. No. 16/736,188, filed on Jan. 7, 2020, entitled "SUPPORT ASSEMBLY FOR AN APPLIANCE," the disclosure of which is hereby incorporated herein by reference in its entirety.

BACKGROUND OF THE DISCLOSURE

The present disclosure generally relates to an appliance, and more specifically, to a support assembly for an appliance.

SUMMARY OF THE DISCLOSURE

According to one aspect of the present disclosure, an appliance includes a cabinet, an inner liner, a mullion, and a support assembly. The inner liner is coupled to the cabinet. The mullion is coupled to the inner liner and defines a retaining space. The support assembly is selectively disposed within the retaining space. The support assembly includes a support surface, a first retention feature, a second retention feature, and a bracket. The support surface is operably coupled to the cabinet. The support surface is configured to transition between a stowed position, a first deployed position, and a second deployed position. The support surface includes a first side and a second side. The first retention feature is operably coupled to the support surface. The second retention feature is operably coupled to the support surface at an opposing end from the first retention feature. The second retention feature is coupled to an end of the support surface. The second retention feature is configured to rotate about an axis relative the cabinet. The bracket is coupled to the support surface. The bracket is disposed along a length of the support surface. The bracket includes a first flange and a second flange. The bracket enables rotation of the support surface in a first direction that corresponds with the first deployed position and a second direction that corresponds with the second deployed position. The first side of the support surface contacts the first flange when the support surface is in the first deployed position. The second side of the support surface contacts the second flange when the support surface is in the second deployed position.

According to another aspect of the present disclosure, an appliance includes a support surface, a retaining space that is defined by an inner liner of the appliance, a bracket, a first retention feature, a second retention feature, and a coupling feature. The support surface is configured to selectively transition between a stowed position, a deployed position, and an intermediate position. The intermediate position is between the stowed position and the deployed position. The retaining space receives the support surface. The bracket is coupled to the support surface. The bracket is disposed along a length of the support surface. The bracket is configured to distribute a load along the length of the support surface when the support surface is in the intermediate position and the deployed position. The first retention feature is operably coupled to the bracket at a first end of the support surface. The second retention feature is operably coupled to the bracket at a second end of the support surface. The second end of the support surface is an opposing end from the first end. The coupling feature is positioned within the retaining space. The coupling feature receives at least one component chosen from the first retention feature and the second retention feature such that the support surface is retained in the stowed position. The coupling feature releases the at least one component chosen from the first retention feature and the second retention feature in response to a compressive force being applied to an edge of the support surface.

According to yet another aspect of the present disclosure, a cabinet includes an inner liner and a support assembly. The inner liner defines a retaining space. The inner liner defines grooves within the retaining space. The support assembly is operably coupled to the inner liner. The support assembly includes a support surface, a first retention feature, a second retention feature, and a bracket. The support surface is operable between a stowed position and a deployed position. The first retention feature and the second retention feature are rotatably coupled to opposing ends of the support surface. The first retention feature and the second retention feature each include a projection that is operably coupled to the support surface. The projections of the first and second retention features define an axis about which the support surface is configured to rotate. The bracket is coupled to each of the first and second retention features. The bracket is coupled to the support surface. The bracket includes flanges that are selectively coupled to the inner liner and configured to brace the support surface in the deployed position of the support surface. The flanges are received within the grooves when the support surface is in the stowed position.

These and other features, advantages, and objects of the present disclosure will be further understood and appreciated by those skilled in the art by reference to the following specification, claims, and appended drawings.

Figure 1:
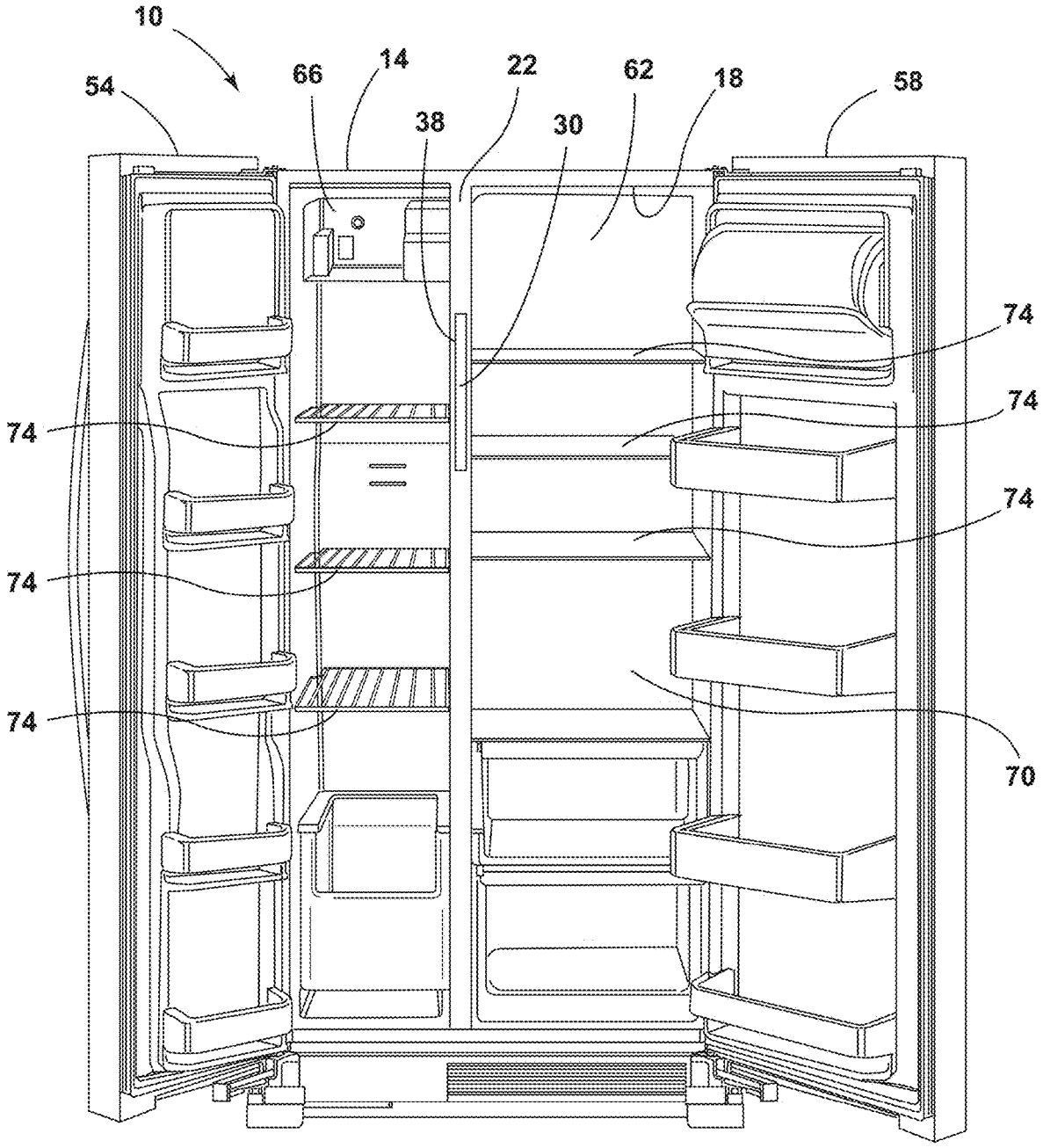
FIG. 1 is a front elevational view of an appliance of the present disclosure with the appliance doors open and a support assembly in a stowed position.

The components in the figures are not necessarily to scale, emphasis instead being placed upon illustrating the principles described herein.

DETAILED DESCRIPTION

The present illustrated embodiments reside primarily in combinations of apparatus components related to a support assembly for an appliance. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-15, reference numeral 10 generally designates an appliance 10 that includes a cabinet 14 and an inner liner 18 coupled to the cabinet 14. A mullion 22 is coupled to the inner liner 18 and defines a retaining space 26. A support assembly 30 is selectively disposed within the retaining space 26 and includes a support surface 34 operably coupled to the cabinet 14. The support surface 34 is configured to transition between a stowed position 38 and a deployed position 42. A retention feature 46 is operably coupled to the support surface 34. A bracket 50 is coupled to and is configured to brace the support surface 34.

Figure 2:
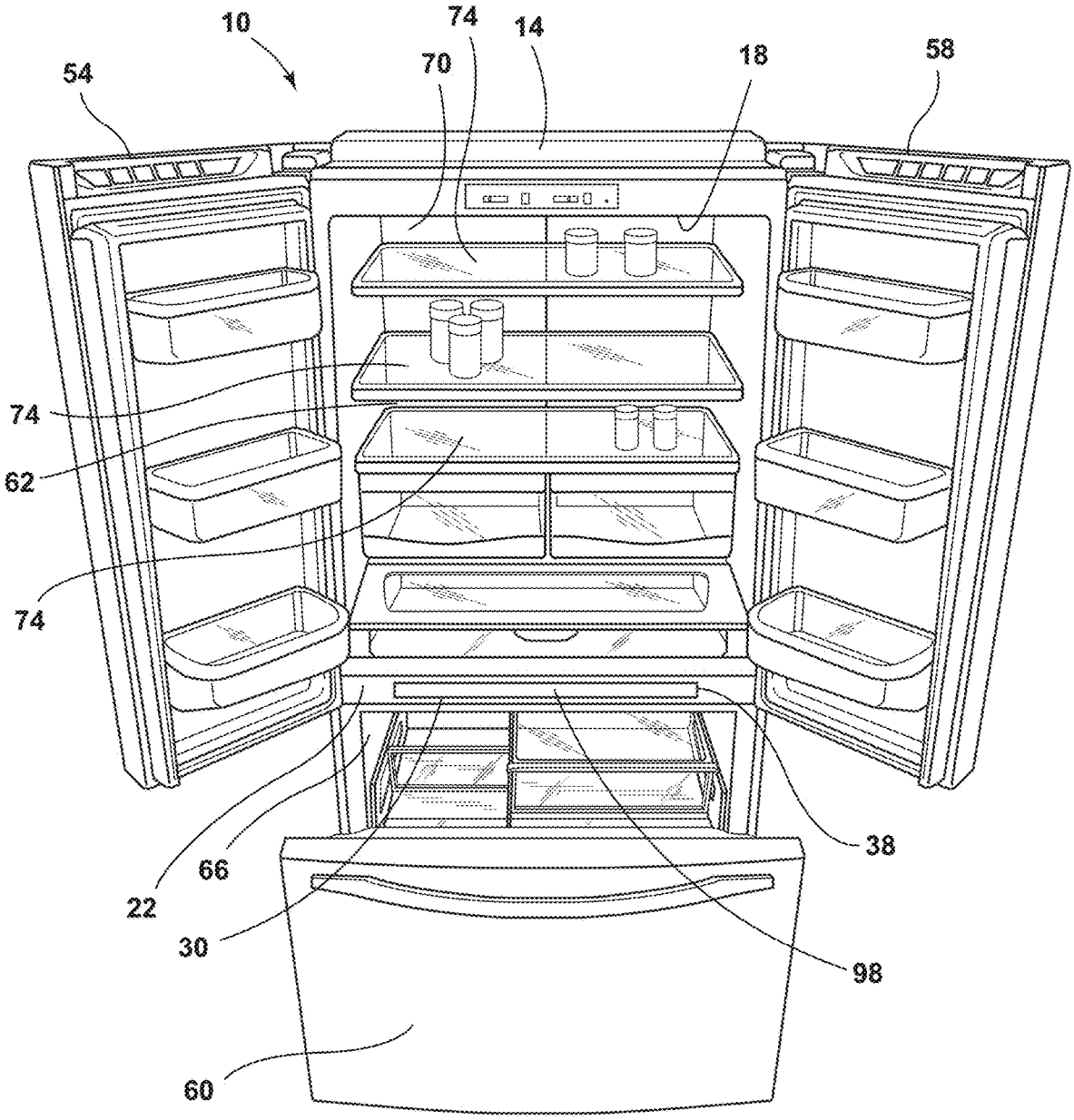
FIG. 2 is a front side perspective view of an appliance of the present disclosure with the appliance doors open and a support assembly in a stowed position.

Referring to FIGS. 1 and 2, the appliance 10 depicted in FIG. 1 is a side-by-side refrigerator appliance 10 with first and second doors 54, 58 in an open position. Additionally or alternatively, the appliance 10 may be configured as a French-door style refrigerator with a bottom-mounted drawer 60 (FIG. 2), such that the first and second doors 54, 58 provide access into a refrigeration compartment 62 and the bottom-mounted drawer 60 provides access into a freezer compartment 66. The refrigeration compartment 62 and the freezer compartment 66 of the appliance 10 are separated by the mullion 22 to each define a storage compartment 70 in which perishable items and other consumer items may be stored. The doors 54, 58 are configured to pivot between open and closed positions to provide selective access to the storage compartment 70. The storage compartment 70 is generally defined by the inner liner 18 that is coupled to the cabinet 14 and may contain a plurality of shelves 74 upon which items may be stored. Although depicted as either the side-by-side appliance 10 or the French-door style appliance 10 with the bottom-mounted drawer 60, it is generally contemplated that the support assembly 30 described herein is contemplated for use in any type of appliance or general storage body.

Figure 3:
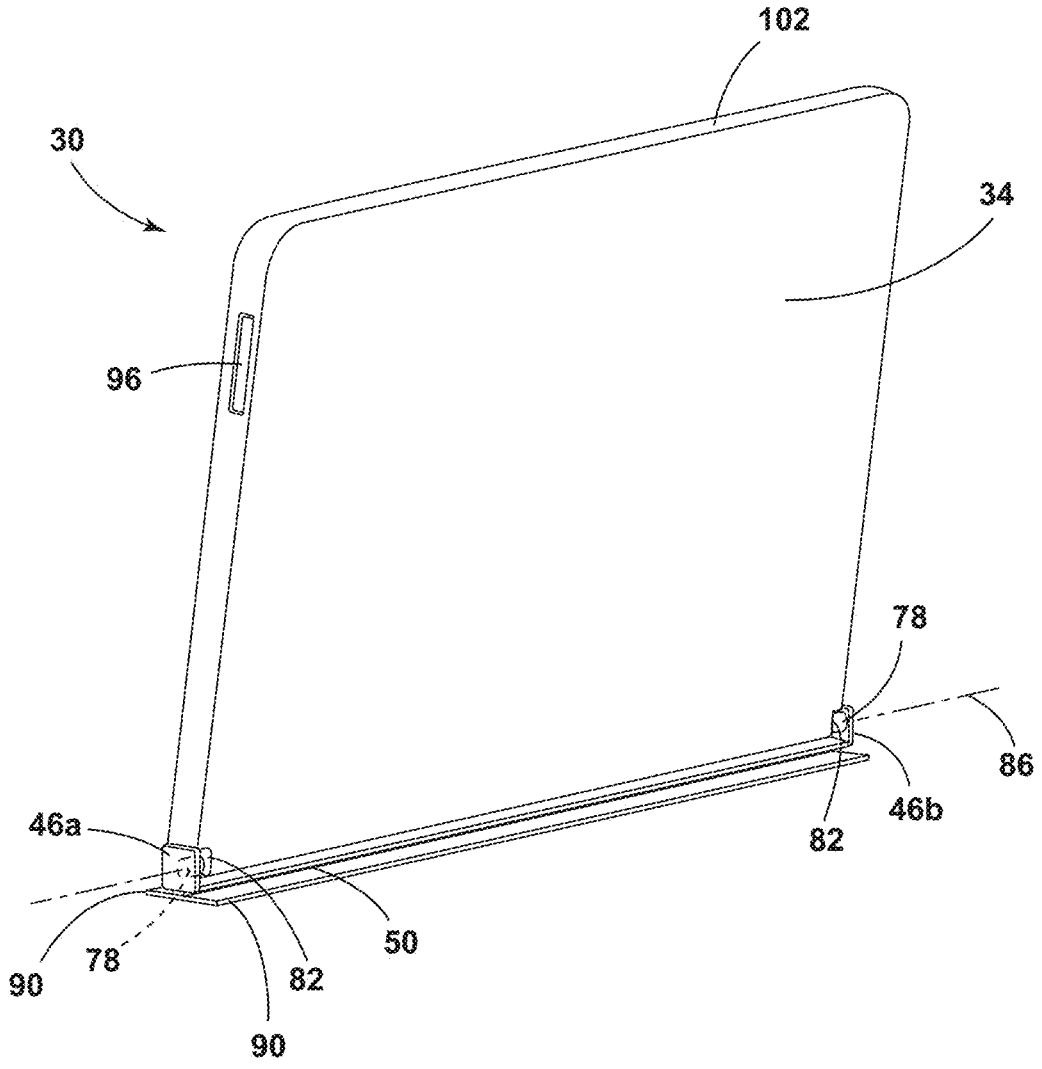
FIG. 3 is a side perspective view of a support assembly of the present disclosure.
Figure 4:
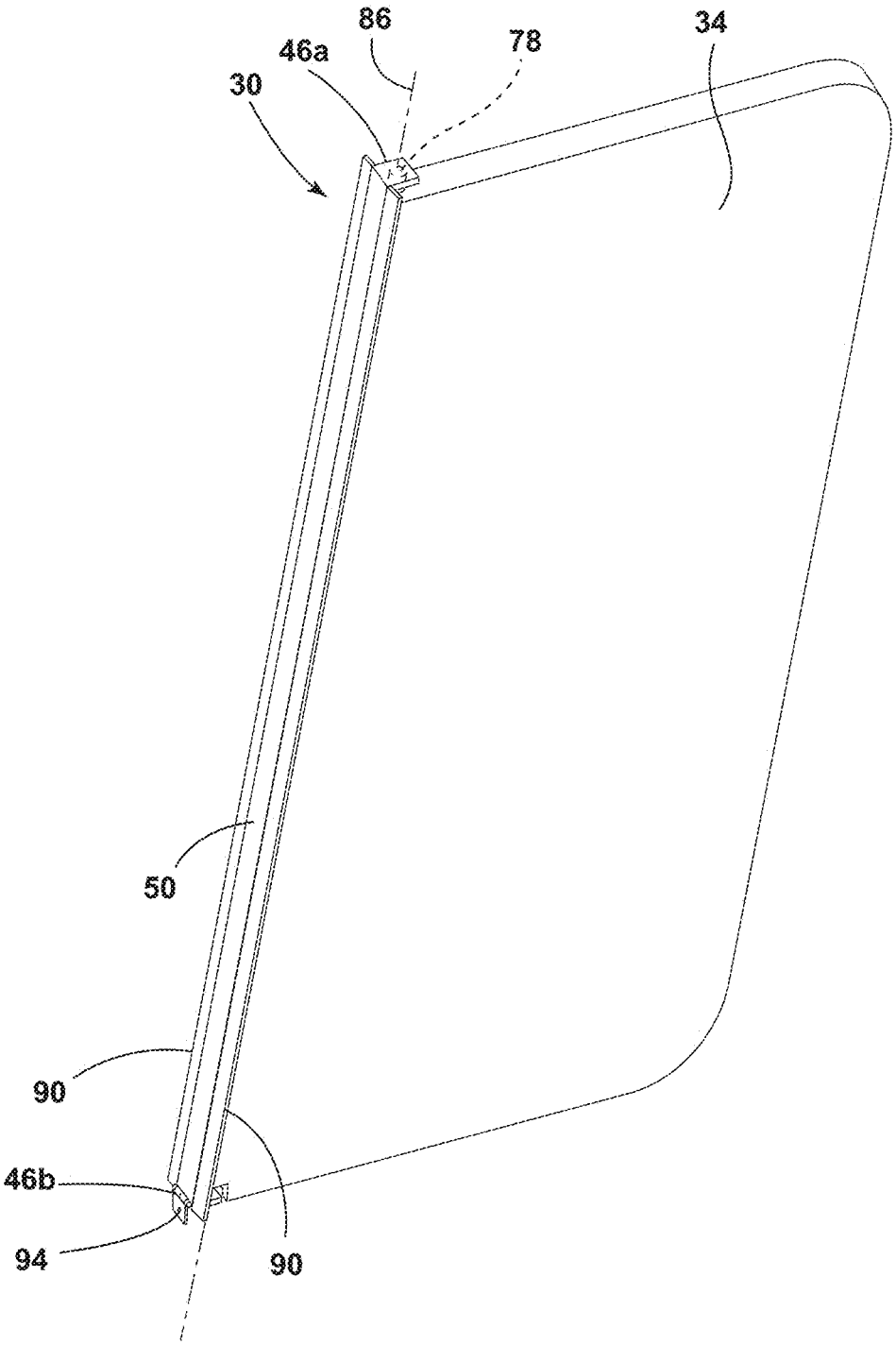
FIG. 4 is a side perspective view of a support assembly of the present disclosure.
Figure 5:
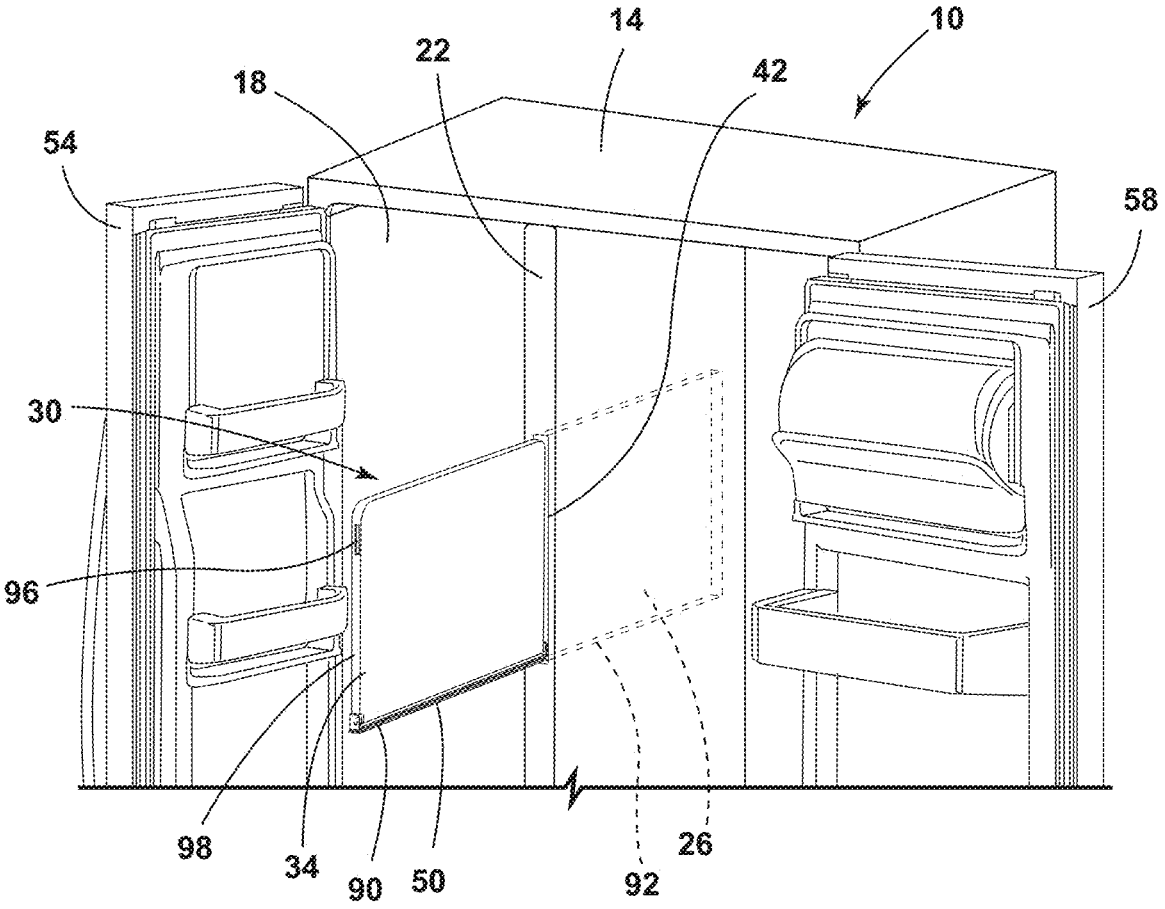
FIG. 5 is a partial front side perspective view of an appliance of the present disclosure with a support assembly in a deployed position.

Referring to FIGS. 3 and 4, the support assembly 30 includes the support surface 34 that is coupled to the bracket 50 by the retention feature 46. It is generally contemplated that the support assembly 30 includes a pair of first and second retention features **46*a*, 46*b* disposed on opposing ends of the support surface 34. Each retention feature 46*a*, 46*b* includes a projection 78 about which the support surface 34 rotates. The rotation of the support surface 34 defines a pivot axis 86 of the support assembly 30. The pivot axis 86 is generally defined through the projections 78, such that the support assembly 34 rotates about the projections 78 and the pivot axis 86. The projections 78 extend through recesses 82 defined by the support surface 34 to couple the retention features 46*a*, 46*b* to the support surface 34**.

The retention features **46*a*, 46*b* are so called because each is configured to couple the bracket 50 to the support assembly 34 and, ultimately, couple the support assembly 34 to the cabinet 14. For example, the retention feature 46*b* illustrated in FIG. 3 is configured to engage a side of the mullion 22 to brace the support surface 34 in the deployed position 42. Additionally or alternatively, the retention feature 46 may be a hinge 94, as illustrated in FIG. 4, that operably couples the support surface 34 to the mullion 22. The hinge 94 is coupled to the bracket 50 and the mullion 22 so the support assembly 30 may hingedly rotate relative to the cabinet 14 from the stowed position 38 into the deployed position 42. In addition, the bracket 50 is also configured to brace the support surface 34 in the deployed position 42 by engaging the support surface 34. For example, the bracket 50 includes flanges 90 that laterally extend from the bracket 50. In the deployed position 42, the support surface 34 may be rotated about the pivot axis 86 to rest along one of the flanges 90 of the bracket 50. Additionally, the support surface 34 defines a grasping aperture 96 to provide a portion of the support surface 34 that a user may grasp to operably move the support surface 34**.

Referring now to FIGS. 1, 3, 5, and 6, the appliance 10 is divided into the freezer compartment 66 and the refrigeration compartment 62 by the mullion 22. In one non-limiting example, the retaining space 26 is defined within the mullion 22, such that the retaining space 26 is disposed between the refrigeration compartment 62 and the freezer compartment 66. The retaining space 26 is a hollow cavity, such that the mullion 22 is generally hollow at the location of the retaining space 26. To maintain insulation between the freezer compartment 66 and the refrigeration compartment 62, it is generally contemplated that the support surface 34 of the support assembly 30 is formed from an insulated panel. Specifically, it is contemplated that the support surface 34 is a vacuum insulated panel so the support surface 34 can provide maximum insulation within the mullion 22 while maintaining a slim construction to fit within the retaining space 26.

The support assembly 30 is positioned within the retaining space 26 and is generally concealed within the retaining space 26 by the mullion 22 and the inner liner 18 when in the stowed position 38. Accordingly, when the support assembly 30 is in the stowed position 38, the support assembly 30 appears to be integrally formed with the mullion 22. In general, the stowed position 38 may be referred to as the first position, and the deployed position 42 may be referred to as the second position. To release the support assembly 30 from the retaining space 26, the user can compress the support surface 34, described in more detail below with respect to FIGS. 9 and 10. As illustrated in FIG. 1, the stowed position 38 may be defined as the support surface 34 being vertically aligned relative to the cabinet 14 and disposed within the retaining space 26. However, as described below, it is also contemplated that the stowed position 38 of the support surface 34 may also be horizontally aligned relative to the cabinet 14, so long as the support surface 34 is disposed within the retaining space 26.

Figure 6:
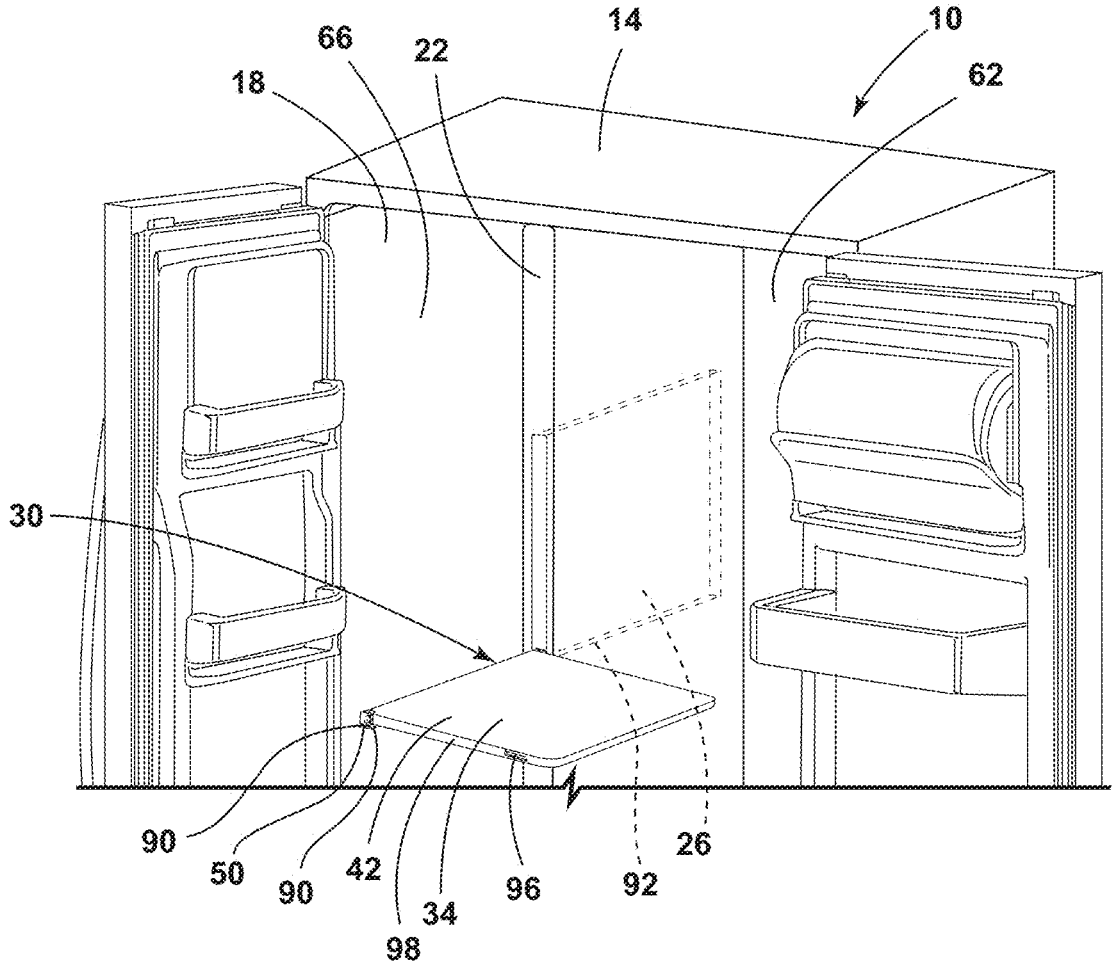
FIG. 6 is a partial front side perspective view of the appliance of FIG. 3 with the support assembly in a support position.

With further reference to FIGS. 1, 3, 5, and 6, the deployed position 42, as illustrated in FIG. 6, is defined as the support surface 34 being generally perpendicular to the mullion 22 and horizontally aligned relative to the cabinet 14. The support surface 34 is rotatably coupled to the mullion 22 to transition between the vertically aligned stowed position 38 and the horizontally aligned deployed position 42. The deployed position 42 may also be defined when the support surface 34 is generally free from the retaining space 26 in the mullion 22, but still vertically aligned relative to the cabinet 14. When in this construction, the support surface 34 may provide a vertical surface against which the user may work. By way of example, not limitation, the user may form a grocery list on the vertical support surface 34 when in the vertically aligned deployed position 42.

Once deployed from the stowed position 38, the support surface 34 may transition into the horizontally aligned deployed position 42 about projections 78 that extends from opposing retention features 46. The support surface 34 defines recesses 82 in which the projections 78 of the retention features 46 can be coupled, such that the support surface 34 may rotate about the projections 78 relative to the bracket 50 to define a pivot axis 86 of the support assembly 30. In addition, the bracket 50 may further include a flange 90 that engages the support surface 34 to prevent circumferential rotation about the pivot axis 86. In addition to engaging the support surface 34, the flange 90 is configured to slidably engage grooves 92 defined within the retaining space 26. The slidable engagement of the flange 90 within the grooves 92 is configured to slidably transition the support assembly 30 from the stowed position 38 in the retaining space 26 into the deployed position 42.

Figure 7:
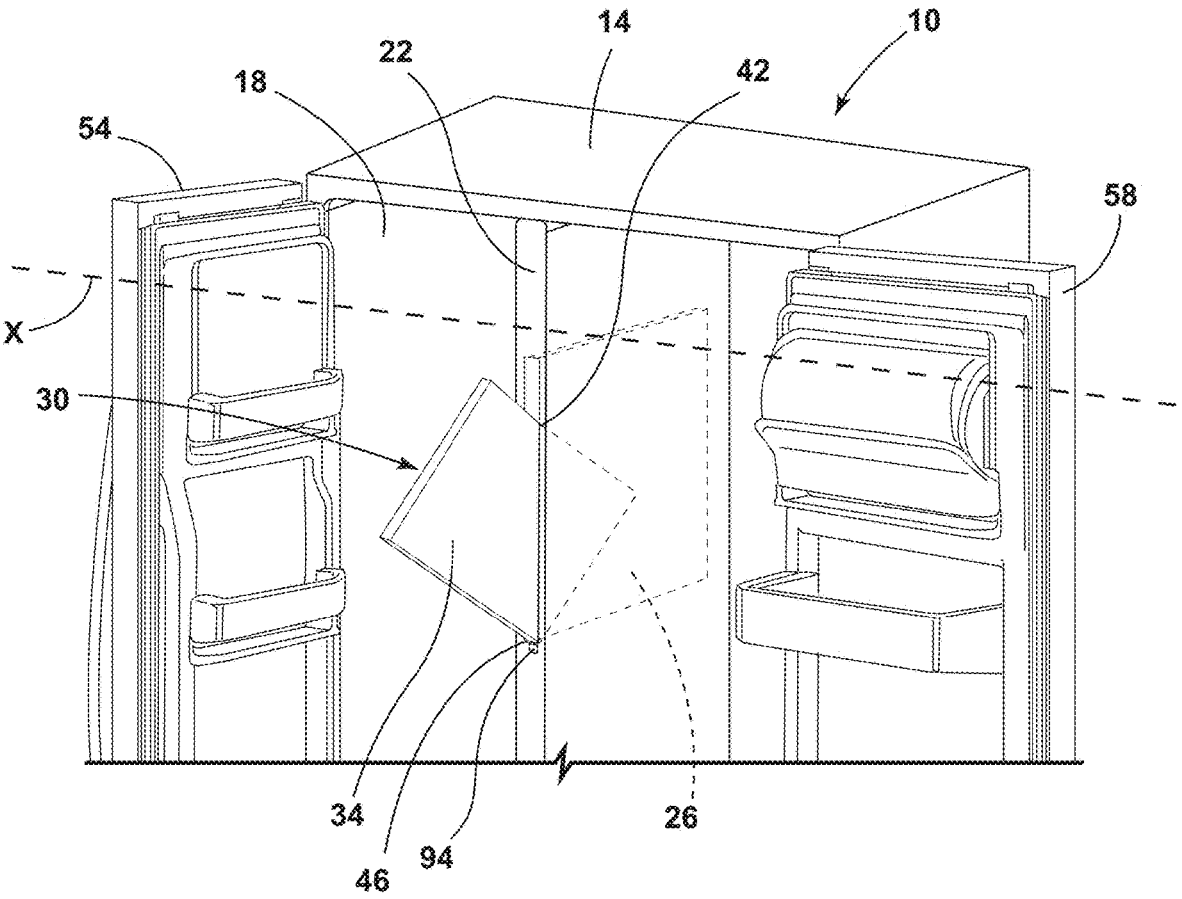
FIG. 7 is a partial front side perspective view of an appliance of the present disclosure with a support assembly in an intermediate position.
Figure 8:
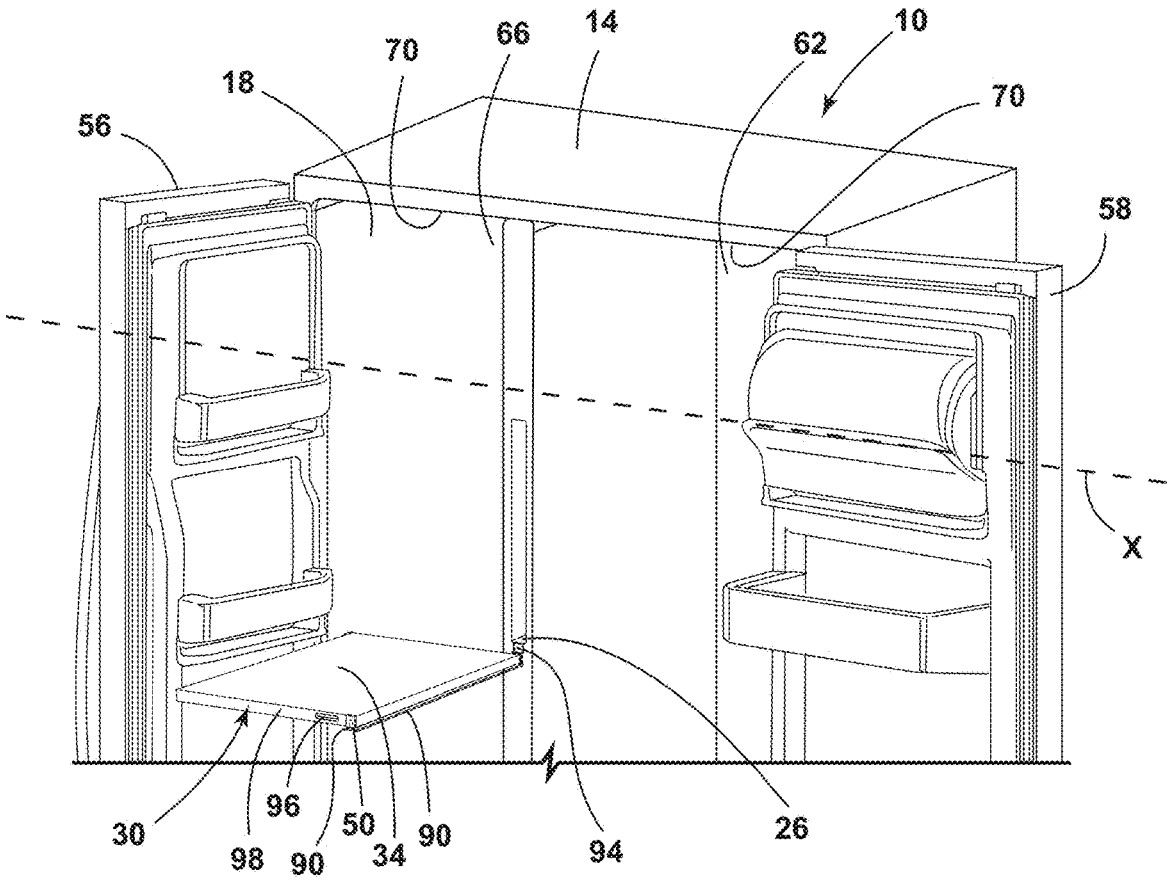
FIG. 8 is a partial front side perspective view of the appliance of FIG. 6 with the support assembly in a deployed position.

In another non-limiting example illustrated in FIGS. 4, 7, and 8, the support assembly 30 is pivotably coupled to the mullion 22, such that the retention feature 46 is the hinge 94, generally described above, that is operably coupled to the bracket 50 and the mullion 22. Stated differently, the support surface 34 is directly coupled to the mullion 22 via the retention feature 46 as the hinge 94. The hinge 94 is configured to hingedly translate the support surface 34 and the bracket 50 in a vertical plane and about an axis X relative to the cabinet 14. Accordingly, the retention feature 46 and the bracket 50 are both configured to transition the support surface 34 from the stowed position 38 (FIG. 1) to the deployed position 42. The user may apply a pulling force to rotate the support surface 34 about the hinge 94 to remove the support surface 34 from the retaining space 26 and into the deployed position 42.

As generally mentioned above, the grasping aperture 96 is defined on an edge 98 of the support surface 34, such that the user may utilize the grasping aperture 96 to rotatably remove the support surface 34 from the retaining space 26 about the axis X. Once the support surface 34 is in the vertically aligned deployed position 42, the support surface 34 can then rotate about the pivot axis 86 to define a support position 100. The horizontally aligned deployed position 42 corresponds to the support position 100. When the support surface 34 is in the support position 100 the user may utilize the support surface 34 to temporarily store various items stored in the appliance 10.

With further reference to FIGS. 4, 7, and 8, the support surface 34 in the support position 100 can also be used as a work station, such that the user may prepare various food items on the support surface 34 to be later stored in the appliance 10. Thus, the support surface 34 is operable as a shelf that outwardly extends from the appliance 10 in the support position 100 so items from either the refrigeration compartment 62 and/or the freezer compartment 66 may be placed on the support surface 34. The support surface 34 is rotatable about the pivot axis 86 to provide the shelf as an extension of either the refrigeration compartment 62 and/or above the freezer compartment 66. In order to minimize the degree of rotation of the support surface 34, the flange 90 of the bracket 50 extends beneath the support surface 34 to engage the support surface 34 in the deployed position 42. The flange 90 extends past the support surface 34 so the support surface 34 may rotate about the pivot axis 86 approximately 180-degrees to provide a flexible arrangement of the support assembly 30. Accordingly, the support surface 34 can be rotated about the projections 78 so as to be positioned in front of either one of the freezer compartment 66 and/or the refrigeration compartment 62.

Figure 9:
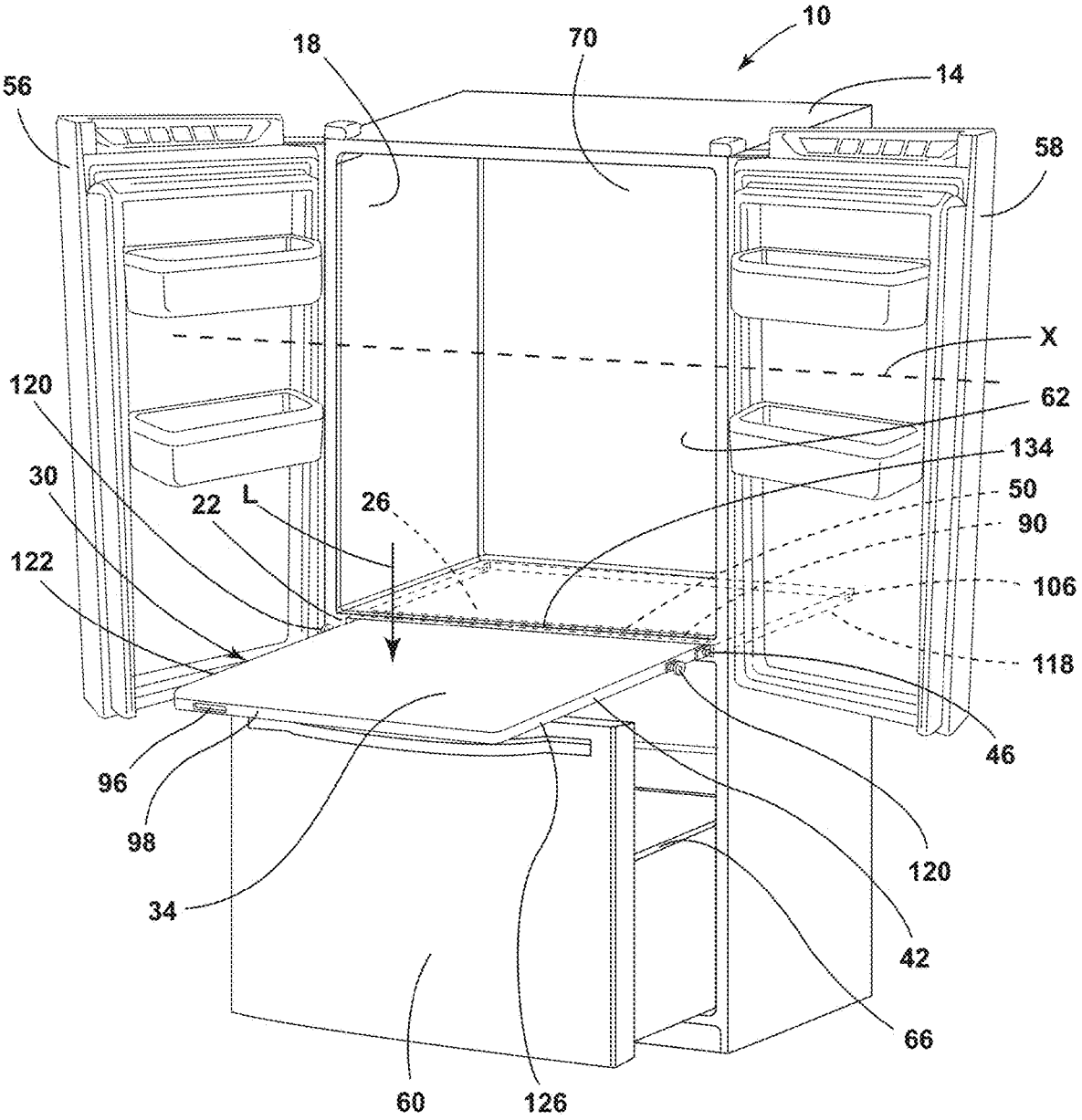
FIG. 9 is a front side perspective view of an appliance of the present disclosure with a support assembly in a deployed position outwardly extending from a lateral mullion.
Figure 10:
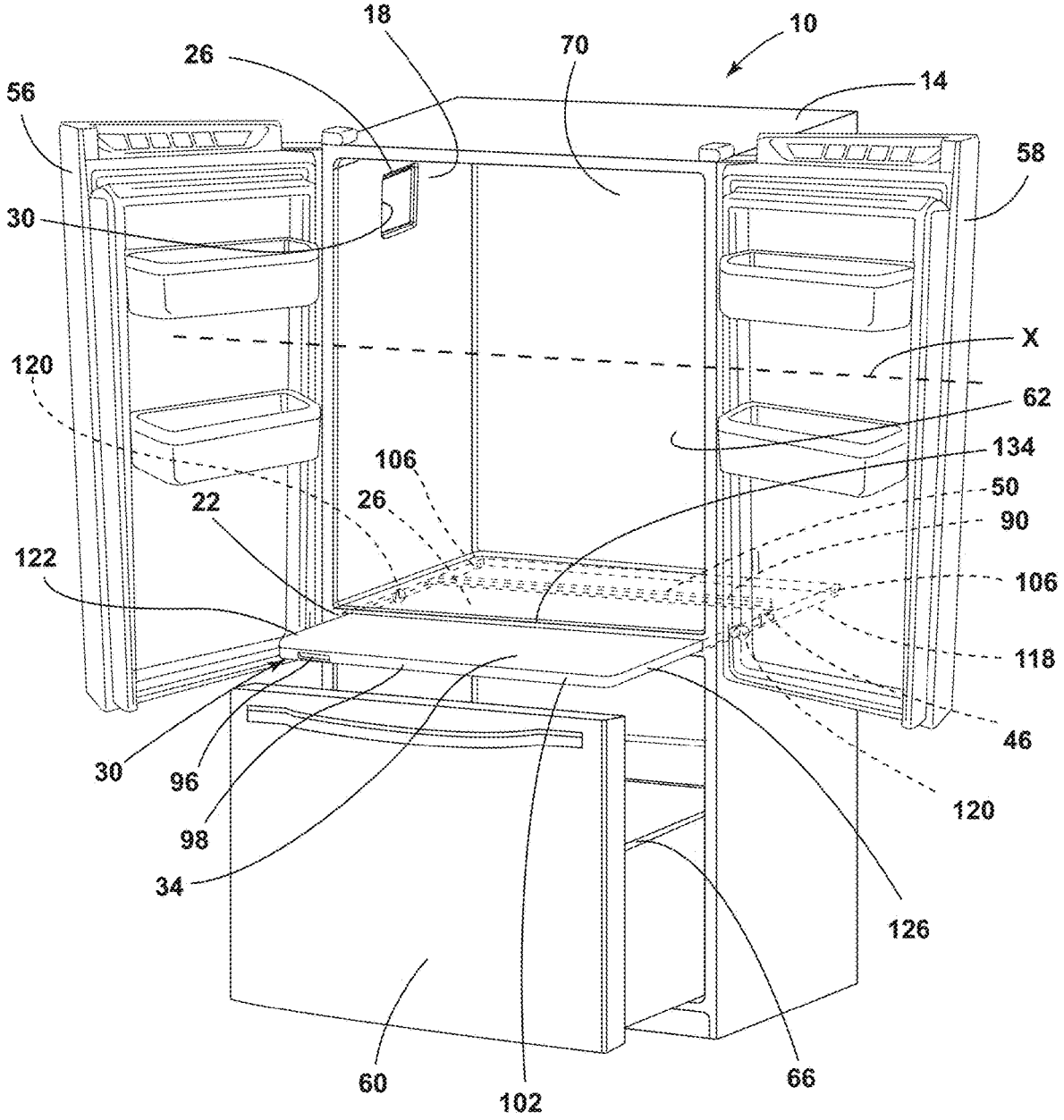
FIG. 10 is a front side perspective view of the appliance of FIG. 8 with the support assembly in an intermediate position.

Referring now to FIGS. 2, 9, and 10 and another non-limiting example, the mullion 22 illustrated divides the freezer compartment 66 and the refrigeration compartment 62 along the axis X, such that the mullion 22 is generally lateral relative to the cabinet 14. In this configuration, the support assembly 30 is positioned within the retaining space 26 defined by the lateral mullion 22. The support assembly 30 is slidably coupled to the mullion 22 within the retaining space 26, such that the support surface 34 can be slidably removed from the retaining space 26. As similarly described above, the support surface 34 is in the stowed position 38 when disposed within the retaining space 26. Thus, the support assembly 30 generally appears integrally formed with the mullion 22 when in the stowed position 38. The support surface 34 is slidably removable from the retaining space 26 into the deployed position 42, and an intermediate position 102 is defined between the stowed position 38 and the deployed position 42, described in further detail below.

To release the support surface 34 from the retaining space 26 within the mullion 22, the user may press upon the edge 98 of the support surface 34 to minimally compress the support surface 34 into the retaining space 26. This compression of the support surface 34 releases a coupling feature 106 positioned within the retaining space 26 that is operably coupled to the retention feature 46 of the support assembly 30. The coupling feature 106 is coupled to the mullion 22 to retain the support assembly 30 in the stowed position 38. It is generally contemplated that the coupling feature 106 engages the retention feature 46, such that the coupling feature 106 receives and retains the retention feature 46. Once the retention feature 46 is received by the coupling feature 106, the coupling feature 106 latches to the retention feature 46 to retain the support surface 34 in the stowed position 38.

With further reference to FIGS. 2, 9, and 10 and as generally mentioned above, a compressive force is applied to the edge 98 of the support surface 34 to release the retention feature 46 from the coupling feature 106. The user may receive tactile and audible feedback upon the compression of the edge 98 that indicates that the retention feature 46 is released. Stated differently, to release the support surface 34 from the coupling feature 106, the user presses upon the edge 98 of the support surface 34 and slides the support surface 34 from the retaining space 26 to transition the support surface 34 through the intermediate position 102 into the deployed position 42. In addition, the support surface 34 will slightly extend out from the retaining space 26, such that the user may grasp the edge 98 of the support surface 34 to fully extend the support surface 34 into the deployed position 42. Additionally or alternatively, the user may use the grasping aperture 96 to withdraw the support surface 34 from the retaining space 26 to use the support surface 34 as a shelf.

Typically, the support surface 34 is utilized in the deployed position 42 to retain items stored within the storage compartment 70 of either the refrigeration compartment 62 or the freezer compartment 66, as discussed above. However, it is also contemplated that the support surface 34 may be used in the intermediate position 102, such that, although there may be a smaller available surface, the support surface 34 can still hold items from the refrigeration compartment 62 or the freezer compartment 66. In particular, the intermediate position 102 may be advantageous when the user is rearranging items within the freezer compartment 66, as the freezer compartment 66 illustrated in FIGS. 2 and 10 is more readily accessible with the support surface 34 in the intermediate position 102. For example, the bottom-mounted drawer 60 extends outward from the cabinet 14 in a similar manner as the support surface 34, such that the support surface 34 may otherwise cover the opening of the freezer compartment 66 when in the deployed position 42. Utilizing the support surface 34 in the intermediate position 102 allows the user to remove items from the freezer compartment 66 and temporarily place the items on the support surface 34. As described, the intermediate position 102 is defined as the position when the support surface 34 partially extends outward from the retaining space 26 while defining a work surface and the support position 100 of the support surface 34, generally described above with respect to FIGS. 4, 7, and 8.

With further reference to FIGS. 9 and 10, guide rails 118 may be coupled to the mullion 22 and operably coupled to the support surface 34 to stabilize and transition the support surface 34 within the retaining space 26. It is generally contemplated that rotatable features 120 may be disposed on a first side 122 and a second side 126 of the support surface 34 and operably coupled to the guide rails 118 to slidably transition the support surface 34 between the stowed position 38 (FIG. 2) and the deployed position 42. In addition, the guide rails 118 engage the rotatable features 120 of the support surface 34 to prevent the support surface 34 from being fully removed from the retaining space 26.

As illustrated in FIGS. 9 and 10, the bracket 50 is securely coupled to the support surface 34, such that the support surface 34 is free from rotation about the pivot axis 86 (FIG. 5) described above. In addition, the bracket 50 is pivotally coupled to the retention feature 46 so a load L that may be placed upon the support surface 34 is distributed by the bracket 50 rather than the retention feature 46. The bracket 50 braces against the mullion 22 to minimize potential rotation of the support surface 34 when in the deployed position 42. Additionally, the mullion 22 may include an engagement wall 134 that is configured to engage the flange 90 of the bracket 50 to further minimize rotation of the support surface 34 about the axis X. Stated differently, once the support surface 34 is in the deployed position 42, the flange 90 of the bracket 50 may brace against the engagement wall 134 of the mullion 22, such that the load L placed upon the support surface 34 may be evenly distributed by the flange 90 across the engagement wall 134 of the mullion 22. It is also contemplated that the engagement wall 134 provides a façade of the mullion 22. Thus, when the support assembly 30 is in the stowed position 38 (FIG. 2), the support assembly 30 appears integrally formed with the mullion 22 as a result of the engagement wall 134 generally concealing the retaining space 26.

Figure 11:
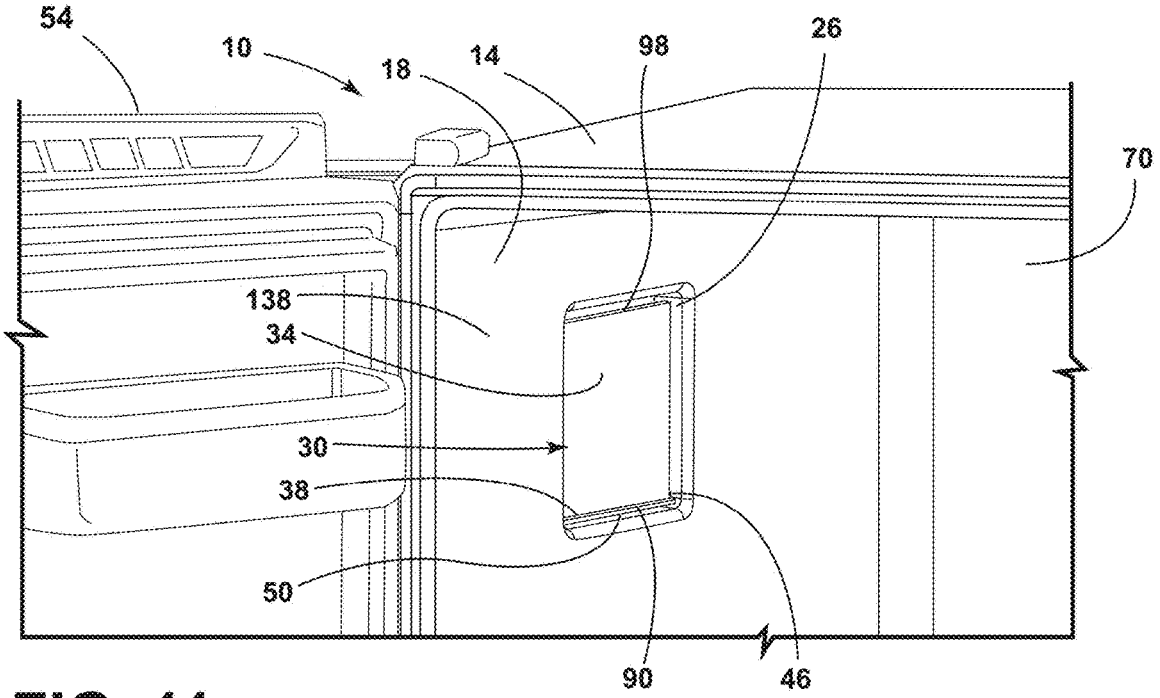
FIG. 11 is an enlarged partial perspective view of a support assembly in a stowed position within a retaining space defined by an inner liner of an appliance of the present disclosure.
Figure 12:
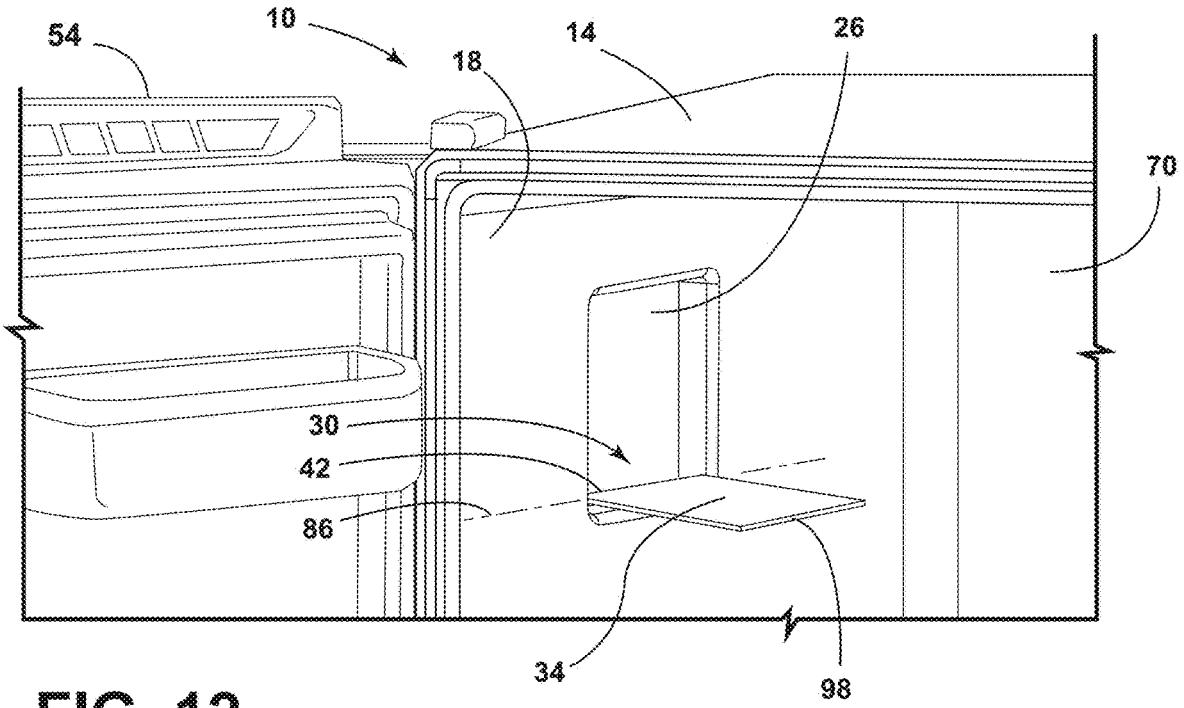
FIG. 12 is an enlarged partial perspective view of the support assembly of FIG. 11 in a deployed position.

Referring now to FIGS. 11 and 12 and yet another non-limiting example, the retaining space 26 is defined by the inner liner 18 of the cabinet 14, such that the retaining space 26 is a generally recessed portion of the inner liner 18. Although depicted on an upper portion 138 of the inner liner 18, it is also contemplated that the retaining space 26 may be defined at any practical location along the inner liner 18. The support surface 34 is generally flush with the inner liner 18 of the cabinet 14 when in the stowed position 38, such that support surface 34 can generally appear integrally formed with the inner liner 18. Additionally or alternatively, the support surface 34 may be slightly smaller than the retaining space 26 so a gap may be defined between the edge 98 of the support surface 34 and a top of the retaining space 26.

A similar coupling feature 106 (FIG. 9) described with respect to FIGS. 9 and 10 may be integrated with the inner liner 18 within the retaining space 26 to couple the retention feature 46 in a similar manner as described above. For example, the user may press upon the support surface 34 to disengage the retention feature 46 from the coupling feature 106 (FIG. 9) to release the support surface 34. The support surface 34 may then pivotally rotate from the stowed position 38 to the deployed position 42 about the pivot axis 86, such that the support surface 34 is hingedly coupled to the inner liner 18. In the deployed position 42, the support surface 34 provides additional storage surfaces other than the shelves 74 disposed within the storage compartment 70, as generally described above.

As illustrated in FIGS. 11 and 12, the support surface 34 may be deployed regardless of the position of the doors 54, 58 (FIG. 2) of the appliance 10. For example, the support surface 34 may be rotated into the deployed position 42 for use as additional shelving and may remain in the deployed position 42 regardless of the position of the doors 54, 58 (FIG. 2). Comparatively, the support assembly 30 illustrated in FIGS. 3-10 are generally functional when the doors 54, 58 (FIG. 2) are in the open position. Thus, the support assembly 30 illustrated in FIGS. 11 and 12 advantageously provides additional surfaces on which items may be arranged within the appliance 10 even with the doors 54, 58 in the close position.

The flange 90 of the bracket 50 may minimize the rotation of the support surface 34 about the pivot axis 86 by engaging the inner liner 18 in the deployed position 42 of the support surface 34. As described above, the projections 78 (FIG. 3) are rotatably coupled to the inner liner 18 to rotate the support surface 34, which may generally engage the flange 90 of the bracket 50. It is generally contemplated that the projections 78 (FIG. 3) may have a semicircular cross-section, such that, upon rotation of the support surface 34 into the deployed position 42, a planar portion of the projections 78 (FIG. 3) may engage the inner liner 18 to minimize further rotation of the support surface 34. However, it is also contemplated that the projections 78 (FIG. 3) may have any configuration typically found in the art for the rotation of bodies about an axis.

Figure 13:
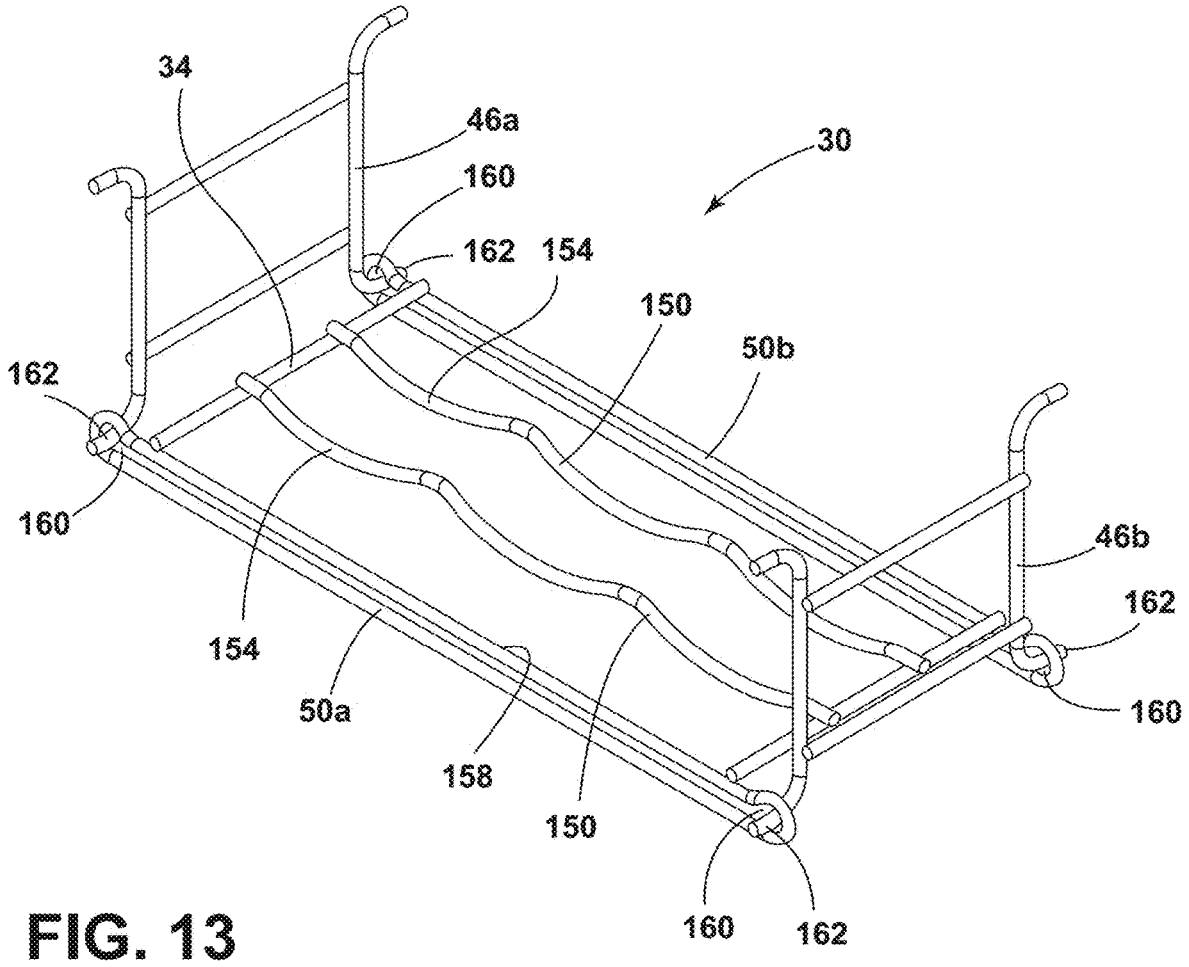
FIG. 13 is a top perspective view of a support assembly of the present disclosure.
Figure 14:
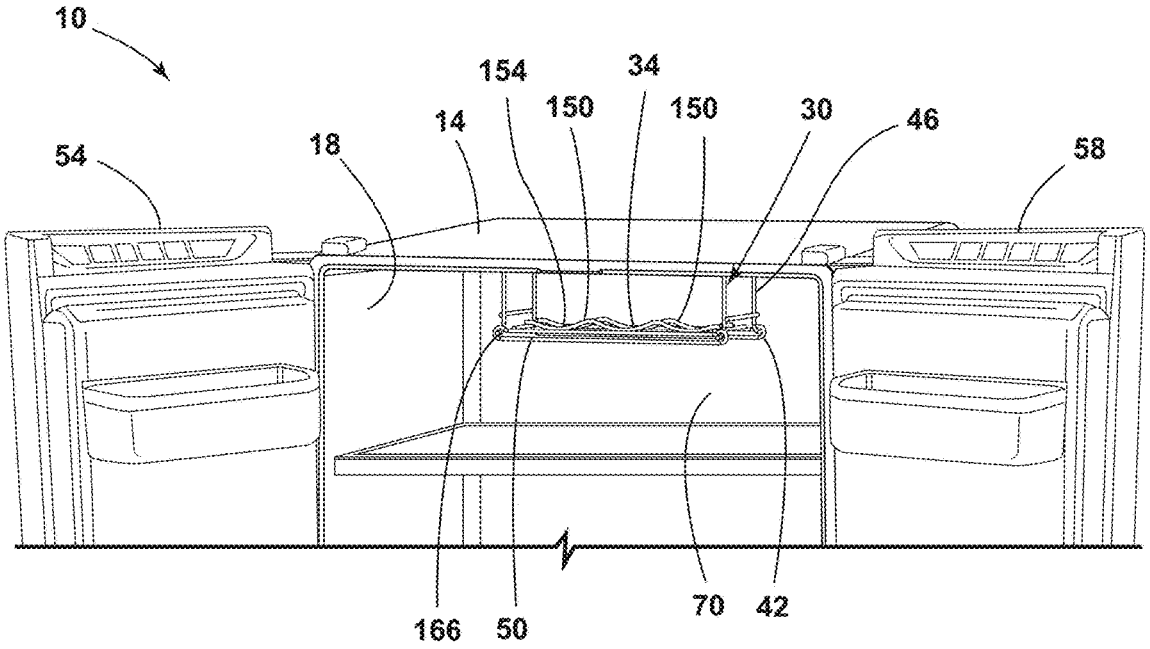
FIG. 14 is an enlarged partial front perspective view of the support assembly of FIG. 13 in a deployed position within an appliance.
Figure 15:
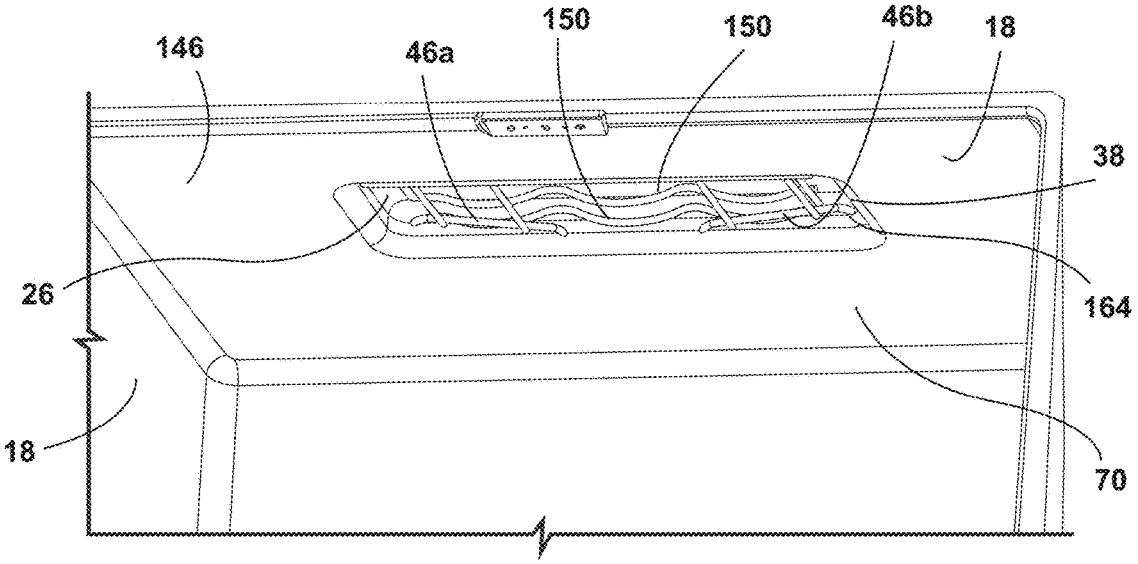
FIG. 15 is an enlarged partial front perspective view of the support assembly of FIG. 13 in a stowed position.

Referring now to FIGS. 13-15 and another non-limiting example, the support assembly 30 is illustrated as extending from a top surface 146 of the inner liner 18. As illustrated, the support assembly 30 is formed from a wire material, such that the support surface 34 is defined by at least two wire cross members 150 to generally form a wire basket. It is contemplated that the wire cross members 150 may define arcuate storage portions 154 that may be used to store items, such as bottles, cans, or other generally cylindrical items. Each item may be cradled within the arcuate storage portions 154 of the wire cross members 150 so the items are retained with minimal lateral rotation. In addition, the support assembly 30 may include a first bracket 50*a* and a second bracket 50*b* that define a perimeter edge 158 of the support assembly 30. Each of the first and second brackets 50*a*, 50*b* defines an opening 160 through which a respective retention feature 46 may extend. As illustrated in FIG. 13, the support assembly 30 has the first retention feature 46*a* and the second retention feature 46*b*, each with extensions 162 that extend through the openings 160 of the first and second brackets 50*a*, 50*b*, respectively.

In such construction, the support surface 34 and the first and second brackets 50*a*, 50*b* may be hingedly transitioned between a raised position 164 and a lowered position 166 by the retention features 46*a*, 46*b*. Generally, the raised position 164 of the support assembly 30 corresponds to the stowed position 38. Similarly, the lowered position 166 of the support assembly 30 generally corresponds to the deployed position 42. For example, when the support surface 34 is in the lowered position 166, the support surface 34 is deployed from the retaining space 26 of the inner liner 18 and may be used to receive items within the appliance 10. When the support assembly 30 is in the raised position 164, the support surface 34 is stowed generally planar with the top surface 146 of the inner liner 18. As similarly mentioned above, but with respect to the illustrated construction in FIGS. 13-15, the support assembly 30 can remain in the lowered position 166 and the deployed position 42 regardless of whether the doors 54, 58 (FIG. 2) are open. Accordingly, the support assembly 30 provides additional storage space within the storage compartment 70 of the appliance 10.

With further reference to FIGS. 13-15, it is generally contemplated that the support assembly 30 is formed from a generally rigid material, such that when the support assembly 30 is in the raised position 164. The rigidity of the support assembly 30 helps to retain the support assembly 30 within the retaining space 26 of the inner liner 18. To release the support assembly 30 from the retaining space 26, the user applies a downward pulling force upon the wire cross members 150 and/or the first and second brackets 50*a*, 50*b* to transition the support assembly 30 into the deployed position 42 and the lowered position 166. When the support assembly 30 is transitioned back into the raised position 164, the extensions 162 of the retention features 46 pivotally rotate within the openings 160 of the brackets 50*a*, 50*b* to raise the support surface 34 toward the top surface 146 of the inner liner 18. As the support surface 34 is transitioned between the intermediate position 102 and the stowed position 164, the retention features 46*a*, 46*b* generally collapse along the support surface 34 and the brackets 50*a*, 50*b*, respectively. Thus, as illustrated, the support assembly 30 may be defined as being both a generally rigid and collapsible assembly.

It is generally advantageous to have the support assembly 30 disposed within the mullion 22 of the appliance 10. For example and as described above, the support surface 34 may be used to temporarily store items that are otherwise generally stored within the storage compartment 70 of the appliance 10. Accordingly, if the user is rearranging the items within the storage compartment 70, then the user may place the items on the support surface 34 so as to easily rearrange and return the items to the shelves in varying order. The support assembly 30 may also provide additional storage spaces within the storage compartments 70 of the appliance 10, such as the wire support assembly 30 and the rotatable shelf outwardly extending from the inner liner 18.

Additionally or alternatively, the support surface 34 may be used as a work surface, such that when the support surface 34 is in the deployed position 42 the support surface 34 is also in the support position 100. While in the support position 100, the support surface 34 may be operable as a workstation. The support assembly 30 is additionally advantageous with regard to the storability of the assembly 30. For example, once the user has completed use of the support surface 34, the user may easily return the support assembly 30 into the retaining space 26. As discussed in detail above, once stored, the support assembly 30 appears generally integrally formed with the mullion 22 and/or liner 18 of the appliance 10.

The disclosure disclosed herein is further summarized in the following paragraphs and is further characterized by combinations of any and all of the various aspects described therein.

According to one aspect of the present disclosure, an appliance includes a cabinet, an inner liner, a mullion, and a support assembly. The inner liner is coupled to the cabinet. The mullion is coupled to the inner liner and defines a retaining space. The support assembly is selectively disposed within the retaining space. The support assembly includes a support surface, a first retention feature, a second retention feature, and a bracket. The support surface is operably coupled to the cabinet. The support surface is configured to transition between a stowed position, a first deployed position, and a second deployed position. The support surface includes a first side and a second side. The first retention feature is operably coupled to the support surface. The second retention feature is operably coupled to the support surface at an opposing end from the first retention feature. The second retention feature is coupled to an end of the support surface. The second retention feature is configured to rotate about an axis relative the cabinet. The bracket is coupled to the support surface. The bracket is disposed along a length of the support surface. The bracket includes a first flange and a second flange. The bracket enables rotation of the support surface in a first direction that corresponds with the first deployed position and a second direction that corresponds with the second deployed position. The first side of the support surface contacts the first flange when the support surface is in the first deployed position. The second side of the support surface contacts the second flange when the support surface is in the second deployed position.

According to another aspect, a support surface is disposed within a retaining space that is defined by a mullion when the support surface is in a stowed position.

According to still another aspect, a support surface is rotatably coupled to a mullion.

According to yet another aspect, a second retention feature is a hinge.

According to another aspect, a bracket is coupled to each of a first retention feature and a second retention feature along a length of a support surface.

According to yet another aspect, a bracket is configured to distribute a load along a length of a support surface.

According to another aspect of the present disclosure, an appliance includes a support surface, a retaining space that is defined by an inner liner of the appliance, a bracket, a first retention feature, a second retention feature, and a coupling feature. The support surface is configured to selectively transition between a stowed position, a deployed position, and an intermediate position. The intermediate position is between the stowed position and the deployed position. The retaining space receives the support surface. The bracket is coupled to the support surface. The bracket is disposed along a length of the support surface. The bracket is configured to distribute a load along the length of the support surface when the support surface is in the intermediate position and the deployed position. The first retention feature is operably coupled to the bracket at a first end of the support surface. The second retention feature is operably coupled to the bracket at a second end of the support surface. The second end of the support surface is an opposing end from the first end. The coupling feature is positioned within the retaining space. The coupling feature receives at least one component chosen from the first retention feature and the second retention feature such that the support surface is retained in the stowed position. The coupling feature releases the at least one component chosen from the first retention feature and the second retention feature in response to a compressive force being applied to an edge of the support surface.

According to another aspect, a plurality of rotatable features are coupled to a support surface. A first side of the support surface and a second side of the support surface each have at least one of the plurality of rotatable features operably coupled thereto.

According to still another aspect, a plurality of rotatable features are positioned proximate to a first retention feature and a second retention feature.

According to yet another aspect, a support surface is a shelf. An edge of the support surface defines a grasping aperture.

According to another aspect, an appliance includes guide rails. A plurality of rotatable features are operably coupled to the guide rails and configured to translate a support surface between a stowed position and a deployed position.

According to yet another aspect of the present disclosure, a cabinet includes an inner liner and a support assembly. The inner liner defines a retaining space. The inner liner defines grooves within the retaining space. The support assembly is operably coupled to the inner liner. The support assembly includes a support surface, a first retention feature, a second retention feature, and a bracket. The support surface is operable between a stowed position and a deployed position. The first retention feature and the second retention feature are rotatably coupled to opposing ends of the support surface. The first retention feature and the second retention feature each include a projection that is operably coupled to the support surface. The projections of the first and second retention features define an axis about which the support surface is configured to rotate. The bracket is coupled to each of the first and second retention features. The bracket is coupled to the support surface. The bracket includes flanges that are selectively coupled to the inner liner and configured to brace the support surface in the deployed position of the support surface. The flanges are received within the grooves when the support surface is in the stowed position.

According to another aspect, a support assembly is disposed within a retaining space of an inner liner when the support surface is in a stowed position.

According to still another aspect, a support surface slidably transitions between a stowed position and a deployed position.

According to yet another aspect, a stowed position vertically aligns a support surface relative to a cabinet and a deployed position horizontally aligns the support surface relative to the cabinet.

According to another aspect, a support assembly includes an insulated panel.

According to yet another aspect, a transition of a support surface between a stowed position and a deployed position includes slidable motion of flanges within grooves.

According to still another aspect, a deployed position includes a first deployed position and a second deployed position.

According to another aspect, flanges of a bracket include a first flange and a second flange. The bracket enables rotation of a support surface in a first direction that corresponds with a first deployed position and a second direction that corresponds with a second deployed position.

According to yet another aspect, a support surface includes a first side and a second side. The first side of the support surface contacts a first flange when the support surface is in a first deployed position. The second side of the support surface contacts a second flange when the support surface is in a second deployed position.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An appliance, comprising:

a cabinet;

an inner liner coupled to the cabinet;

a mullion coupled to the inner liner and defining a retaining space; and a support assembly selectively disposed within the retaining space, the support assembly comprising:

a support surface operably coupled to the cabinet, the support surface configured to transition between a stowed position, a first deployed position, and a second deployed position, wherein the support surface comprises a first side and a second side;

a first retention feature operably coupled to the support surface;

a second retention feature operably coupled to the support surface at an opposing end from the first retention feature, wherein the second retention feature is coupled to an end of the support surface, and wherein the second retention feature is configured to rotate about an axis relative the cabinet; and a bracket coupled to the support surface, wherein the bracket is disposed along a length of the support surface, wherein the bracket includes a first flange and a second flange, wherein the bracket enables rotation of the support surface in a first direction that corresponds with the first deployed position and a second direction that corresponds with the second deployed position, wherein the first side of the support surface contacts the first flange when the support surface is in the first deployed position, wherein the second side of the support surface contacts the second flange when the support surface is in the second deployed position, wherein the support surface extends beyond the first flange when the support surface is in the first deployed position, and wherein the support surface extends beyond the second flange when the support surface is in the second deployed position.

2. The appliance of claim 1, wherein the support surface is disposed within the retaining space defined by the mullion when the support surface is in the stowed position.

3. The appliance of claim 2, wherein the support surface is rotatably coupled to the mullion.

4. The appliance of claim 3, wherein the second retention feature is a hinge.

5. The appliance of claim 1, wherein the bracket is coupled to each of the first retention feature and the second retention feature along the length of the support surface.

6. The appliance of claim 1, wherein the bracket is configured to distribute a load along the length of the support surface.

7. An appliance, comprising:

an inner liner defining a retaining space, wherein the inner liner defines grooves within the retaining space; and a support assembly operably coupled to the inner liner, the support assembly including:

a support surface operable between a stowed position and a deployed position;

a first retention feature and a second retention feature rotatably coupled to opposing ends of the support surface, the first retention feature and the second retention feature each including a projection operably coupled to the support surface, and wherein the projections of the first and second retention features define an axis about which the support surface is configured to rotate; and a bracket coupled to each of the first and second retention features, wherein the bracket is coupled to the support surface, the bracket including flanges selectively coupled to the inner liner and configured to brace the support surface in the deployed position of the support surface, wherein the flanges are received within the grooves when the support surface is in the stowed position.

8. The appliance of claim 7, wherein the support assembly is disposed within the retaining space of the inner liner when the support surface is in the stowed position.

9. The appliance of claim 7, wherein the support surface slidably transitions between the stowed position and the deployed position.

10. The appliance of claim 7, wherein the stowed position vertically aligns the support surface relative to the cabinet and the deployed position horizontally aligns the support surface relative to the cabinet.

11. The appliance of claim 7, wherein the support assembly comprises an insulated panel.

12. The appliance of claim 7, wherein a transition of the support surface between the stowed position and the deployed position comprises slidable motion of the flanges within the grooves.

13. The appliance of claim 7, wherein the deployed position comprises a first deployed position and a second deployed position.

14. The appliance of claim 13, wherein the flanges of the bracket comprise a first flange and a second flange, and wherein the bracket enables rotation of the support surface in a first direction that corresponds with the first deployed position and a second direction that corresponds with the second deployed position.

15. The appliance of claim 14, wherein the support surface comprises a first side and a second side, wherein the first side of the support surface contacts the first flange when the support surface is in the first deployed position, and wherein the second side of the support surface contacts the second flange when the support surface is in the second deployed position.

16. An appliance, comprising:

a cabinet;

an inner liner coupled to the cabinet;

a mullion coupled to the inner liner and defining a retaining space; and a support assembly selectively disposed within the retaining space, the support assembly comprising:

a support surface operably coupled to the cabinet, the support surface configured to transition between a stowed position, a first deployed position, and a second deployed position, wherein the support surface comprises a first side and a second side;

a first retention feature operably coupled to a first edge of the support surface;

a second retention feature operably coupled to a second edge of the support surface at an opposing end from the first retention feature, wherein the first edge and the second edge define opposing ends of the support surface, and wherein the second retention feature is configured to rotate about an axis relative the cabinet, wherein the support surface extends beyond the first flange when the support surface is in the first deployed position, and wherein the support surface extends beyond the second flange when the support surface is in the second deployed position; and a bracket coupled to the support surface, wherein the bracket is disposed along a length of the support surface, wherein the bracket includes a first flange and a second flange, wherein the bracket enables rotation of the support surface in a first direction that corresponds with the first deployed position and a second direction that corresponds with the second deployed position, wherein the first side of the support surface contacts the first flange when the support surface is in the first deployed position, and wherein the second side of the support surface contacts the second flange when the support surface is in the second deployed position.

17. The appliance of claim 16, wherein the first retention feature and the second retention feature each include a projection that engages with the support surface, and wherein the projections of the first and second retention features define the axis about which the support surface is configured to rotate.

18. The appliance of claim 16, wherein the support surface is rotatably coupled to the mullion.

19. The appliance of claim 18, wherein the second retention feature is a hinge.

* * * * *